US005212146A

United States Patent [19]

Komamura et al.

[11] Patent Number: 5,212,146

[45] Date of Patent: May 18, 1993

[54] HEAT-SENSITIVE TRANSFER RECORDING MATERIAL

[75] Inventors: Tawara Komamura; Katsunori Katoh; Yoriko Ikehata, all of Hino, Japan

[73] Assignee: Konica Corporation, Tokyo, Japan

[21] Appl. No.: 719,823

[22] Filed: Jun. 24, 1991

[30] Foreign Application Priority Data

Jul. 2, 1990 [JP] Japan ..... 2-175660

[51] Int. Cl.[5] ..... B41M 5/035; B41M 5/38

[52] U.S. Cl. ..... 503/227; 428/195; 428/336; 428/913; 428/914

[58] Field of Search ..... 8/471; 428/195, 913, 428/914, 336; 503/227

[56] References Cited

U.S. PATENT DOCUMENTS 5,037,799 8/1991 Chapman et al. ..... 503/227

*Primary Examiner*—B. Hamilton Hess

*Attorney, Agent, or Firm*—Frishauf, Holtz, Goodman & Woodward

[57] ABSTRACT

Disclosed is a heat-sensitive transfer recording material having a colorant layer containing a colorant transferable by heat, wherein a compound represented by the formula [I] shown below is contained in said colorant layer and/or a layer adjacent to said colorant layer:

Formula (I)

[wherein $M^{2+}$ represents a chelatable metal ion, $R^1$ and $R^2$ each independently represent hydrogen atom, a halogen atom, a monovalent organic group, X represents —$OR^5$ and hydroxyl group (where $R^3$, $R^4$, $R^5$ each independently represent an alkyl group which may also have a substituent), Y represents a 6-membered nitrogen containing aromatic heterocyclic ring together with Z represents an anion, m represents 1 or 2 and n represents 1 or 2].

23 Claims, 1 Drawing Sheet

HEAT-SENSITIVE TRANSFER RECORDING MATERIAL

BACKGROUND OF THE INVENTION

This invention relates to a heat-sensitive transfer recording material, more particularly to a heat-sensitive transfer recording material which can transfer a colorant by the heat generated by irradiation of photoenergy by, for example, laser, etc. to form a sharp image on an image-receiving material.

As the method for obtaining a color hard copy, investigations have been made about color recording techniques using ink jet, electrophotography, heat-sensitive transfer, etc.

Among these, particularly the heat-sensitive transfer system has such advantages as easy operation and maintenance, possibility of miniaturization of the apparatus, reduction of cost, and further inexpensive running cost, etc.

The heat-sensitive transfer recording system includes two types of systems. One is the system in which the transfer sheet (also called heat-sensitive transfer material) having a heat-meltable ink layer on a support is heated by a heat-sensitive head to have the above ink transferred by melting onto a transferable sheet (also called image-receiving material), and the other is the thermal diffusion transfer system (including the sublimation transfer system) in which a transfer sheet having an ink layer containing a thermally diffusible dye (including sublimable dye) on a support is heated by a heat-sensitive head to transfer the above thermally diffusible dye onto a transferable sheet. Of these, the thermal diffusion transfer system is more advantageous for full color recording, because the tone of image can be controlled by varying the amount of the dye transferred depending on the change in thermal energy of the heat-sensitive head.

In the prior art, as the heating method of a heat-sensitive transfer recording material, there have been generally employed the methods using a heat-generating body such as thermal head, etc., and the method of using a laser as the heat energy source has been also known.

In the method using a laser, when a heat-sensitive transfer recording material is exposed to laser beam, the laser beam is converted to heat energy, whereby the colorant in the vicinity exposed is heated, and the colorant corresponding to such heating is heat transferred to form an image in the image-receiving material.

The image forming method according to this method is disclosed in U.K. Patent No. 2,083,726A and Japanese Unexamined Patent Publication No. 2074/1990.

In this method, a substance which absorbs strongly the laser wavelength (laser absorbing substance) is contained in the heat-sensitive transfer recording material, and the laser absorbing substance absorbs photoenergy to convert it efficiently to heat energy.

As the above-mentioned laser substance, carbon and a specific IR-ray absorbing substance have been employed.

However, when carbon is used, since it is added in the form of fine particles, carbon particles are liable to be agglomerated, and hence there is the problem that the quality of the image by transfer of the colorant tends to be lowered.

On the other hand, when an IR-ray absorbable cyanine dye disclosed in Japanese Unexamined Patent Publication No. 2074/1990 is used, due to poor stability of the IR-ray absorbing dye itself, the density of the IR-ray absorbing dye will be lowered by heat, humidity or light, etc. during storage of the heat-sensitive transfer recording material, whereby there is involved the problem that the recording sensitivity with laser beam of the heat-sensitive transfer recording material may be sometimes deteriorated.

Further, carbon and the above-mentioned IR-ray absorbing dyes were also themselves transferred into the image-receiving material, thus having the problem of deteriorating the quality of image.

Therefore, an object of the present invention is to solve the problems as mentioned above of the heat-sensitive transfer recording material which performs image recording by use of a light such as laser beam.

SUMMARY OF THE INVENTION

The present invention for solving the above task is a heat-sensitive transfer recording material having a colorant layer containing a colorant transferable by heat, wherein a compound represented by the formula [I] shown below is contained in said colorant layer and/or a layer adjacent to said colorant layer:

Formula (I)

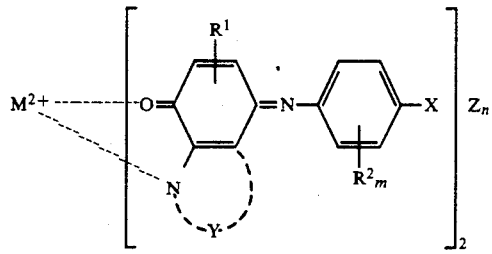

[wherein $M^{2+}$ represents a chelatable metal ion, $R^1$ and $R^2$ each independently represent hydrogen atom, a halogen atom, a monovalent organic group, X represents

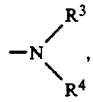

$-OR^5$ and hydroxyl group (where $R^3$, $R^4$, $R^5$ each independently represent an alkyl group which may also have a substituent), Y represents a 6-membered nitrogen containing aromatic heterocyclic ring together with

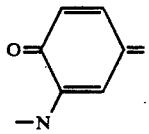

Z represents an anion, m represents 1 or 2 and n represents 1 or 2].

DESCRIPTION OF THE PREFERRED EMBODIMENTS

Figure 1:
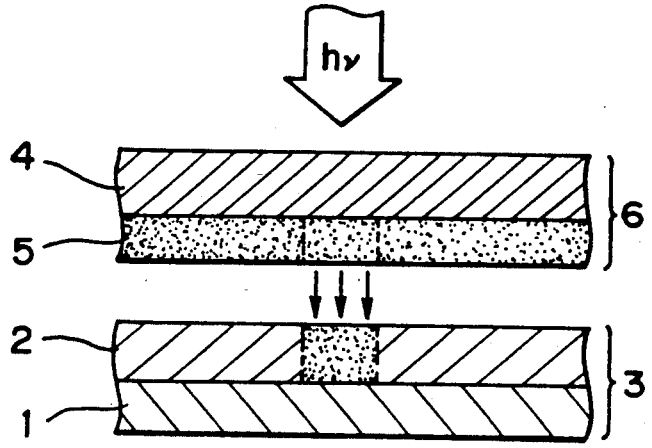
FIG. 1 is an illustration showing the image forming principle with the heat-sensitive transfer recording material of the present invention.

The heat-sensitive transfer recording material of the present invention contains a compound in the above formula [I] in the colorant layer containing a colorant and/or a layer adjacent to the colorant layer formed on a support.

In the above formula [I], $M^{2+}$ is represents a chelatable metal ion. Preferable examples of the metal ion can include divalent transition metal ions, particularly $Ni^{2+}$, $Cu^{2+}$, $Fe^{2+}$, $Co^{2+}$, $Zn^{2+}$.

The above-mentioned $R^1$ and $R^2$ each independently represent hydrogen atom, a halogen atom (preferably fluorine atoms, chlorine atom, bromine atoms), a monovalent organic group.

Preferable examples of the monovalent organic group may include alkyl groups (e.g. methyl, ethyl, isopropyl, n-butyl), cycloalkyl groups (e.g. cyclopentyl, cyclohexyl or the like), aryl groups (e.g. phenyl, naphthyl or the like), alkenyl groups (e.g. 2-propenyl or the like), aralkyl groups (e.g. benzyl, 2-phenethyl or the like), alkoxy groups (e.g. methoxy, ethoxy, isopropoxy, n-butoxy or the like), aryloxy groups (e.g. phenoxy or the like), cyano group, acylamino groups (e.g. acetylamino, propionylamino or the like), alkylthio groups (e.g. methylthio, ethylthio, n-butylthio or the like), arylthio groups (e.g. phenylthio), sulfonylamino groups (e.g. methanesulfonylamino, benzenesulfonylamino or the like), ureido groups (e.g. 3-methylureido, 3,3-dimethylureido, 1,3-dimethylureido or the like), carbamoyl groups (e.g. methylcarbamoyl, ethylcarbamoyl, dimetylcarbamoyl or the like), sulfamoyl groups (e.g. ethylsulfamoyl, dimethylsulfamoyl or the like), alkoxycarbonyl groups (e.g. methoxycarbonyl, ethoxycarbonyl or the like), aryloxycarbonyl groups (e.g. phenoxycarbonyl or the like), sulfonyl groups (e.g. methanesulfonyl, butanesulfonyl, phenylsulfonyl or the like), acyl groups (e.g. acetyl, propanoyl, butyroyl or the like), amino groups (methylamino, ethylamino, dimethylamino or the like).

When m is 2, the two existing $R^2$ may be either the same or different from each other.

X represents

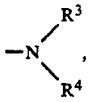

—$OR^5$ or hydroxyl group, $R^3$, $R^4$, $R^5$ each independently represent an alkyl group (e.g. methyl, ethyl, n-propyl, n-butyl) which may also have a substituent. Examples of the substituent may include aryl groups (e.g. phenyl or the like), alkoxy groups (e.g. methoxy, ethoxy or the like), amino groups (e.g. methylamino, ethylamino or the like), acylamino groups (e.g. acetylamino or the like), sulfonyl groups (e.g. methanesulfonyl or the like), alkoxycarbonyl groups (e.g. methoxycarbonyl or the like), cyano group, nitro group, halogen atoms (e.g. chlorine, fluorine or the like), alkylsulfonylamino groups (e.g. methanesulfonylamino), hydroxyl group and so son.

Y represents a mass of atoms forming a 6-membered nitrogen containing aromatic heterocyclic ring together with

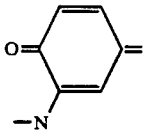

(which may also have a a substituent on the ring), preferably the rings shown below:

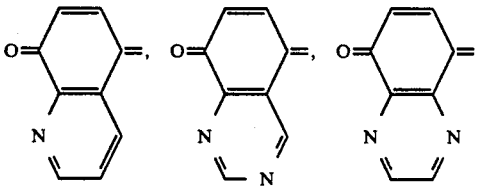

Z represents an anion. Preferable anions may include $Cl^-$, $Br^-$, $ClO_4^-$, $R^6COO^-$, $R^6SO_3^-$, $R^6{}_4B^-$, $SO_4^{2-}$. Here, $R^6$ represents an alkyl group, a cycloalkyl group and an aryl group.

As the alkyl group represented by $R^6$, for example, methyl, ethyl, propyl, butyl, pentyl, hexyl, octyl groups and the like can be icnluded, and these alkyl groups may be also substituted with halogen atoms. Preferable alkyl groups represented by $R^6$ are alkyl groups having 1 to 4 carbon atoms which may be also substituted with halogen atoms.

As the cycloalkyl group represented by $R^6$, cyclopentyl, cyclohexyl, cyclooctyl groups and the like can be included. A preferable cycloalkyl groups is cyclohexyl.

As the aryl group represented by $R^6$, phenyl group, a phenyl group having a substituent such as alkyl group, etc., naphthyl group, a naphthyl group having a substituent such as alkyl group and the like can be included.

m represents 1 or 2, and n represents 1 or 2.

In the compound (complex) represented by the formula [I], the ligand:

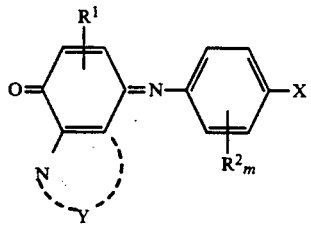

is coordinated in number of 2 relative to the metal ion $M^{2+}$, and the two ligands here may be the same or different from each other.

In the following, specific examples represented by the formula [I] are shown.

The compounds (1)–(18) included in the formula [I] have the contents of $M^{2+}$, $R^1$, m, $R^2$, X and Z in the formula shown below as shown in the following Table 1.

-continued

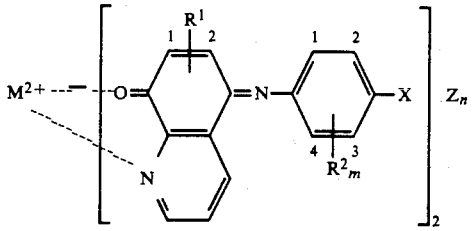

TABLE 1

| | $M^{2+}$ | $R^1$ | m | $R^2$ | X | Z |
|---|---|---|---|---|---|---|
| (1) | $Ni^{2+}$, | H, | 1, | 1-$CH_3$, | $-N(C_2H_5)_2$, | $[(C_6H_5)_4B^-]_2$ |
| (2) | $Cu^{2+}$, | H, | 1, | 1-$CH_3$, | $-N(C_2H_5)_2$, | $[(C_6H_5)_4B^-]_2$ |
| (3) | $Ni^{2+}$, | 1-$CH_3$, | 1, | 1-$OCH_3$, | $-N(C_2H_5)(C_2H_4OH)$, | $[(C_6H_5)_4B^-]_2$ |
| (4) | $Cu^{2+}$, | 1-Cl, | 2, | 1-$CH_3$, 3-$CH_3$ | $-N(C_2H_5)(C_2H_4OCH_3)$, | $[(C_6H_5)_4B^-]_2$ |
| (5) | $Zn^{2+}$, | 1-Cl, | 1, | 1-$CH_3$, | $-N(C_2H_5)(C_2H_4NHSO_4CH_3)$, | $[(C_6H_5)_4B^-]_2$ |
| (6) | $Ni^{2+}$, | 1-$C_2H_5CONH-$, | 1, | H, | $-N(C_2H_5)(C_2H_5)$, | $[(C_6H_5)_4B^-]_2$ |
| (7) | $Cu^{2+}$, | 1- 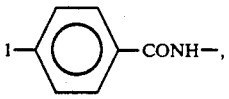 , | 1, | 1-$CH_3$, | $-N(C_3H_7(n))(C_3H_7(n))$, | $[(C_6H_5)_4B^-]_2$ |
| (8) | $Co^{2+}$, | 1-$C_2H_5SO_2NH$, | 1, | 1-$CH_3$, | $-N(C_2H_5)(C_2H_4Cl)$, | $[(C_6H_5)_4B^-]_2$ |
| (9) | $Ni^{2+}$, | 1-$NHCOC_{14}H_{29}$, | 1, | 1-$CH_3$, | $-N(C_2H_5)(C_2H_5)$, | $[(C_6H_5)_4B^-]_2$ |
| (10) | $Ni^{2+}$, | 1-$NHCOCH(C_2H_5)O-$, $-C_5H_{11}(t)$, | 1, | 1-$CH_3$, | $-N(C_2H_5)_2$, | $(ClO_4^-)_2$ |
| (11) | $Fe^{2+}$, | 1-$CONHC_6H_{13}$, | 1, | 1-$CH_2NHSO_2CH_3$, | $-N(C_2H_5)_2$, | $[C_{12}H_{25}-SO_3^-]_2$ |
| (12) | $Ni^{2+}$, | 1- 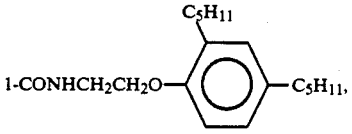 , | 1, | 1-$CH_3$, | $-N(C_2H_5)_2$, | $(Cl^-)_2$ |

TABLE 1-continued

| | $M^{2+}$ | $R^1$ | m | $R^2$ | X | Z |
|---|---|---|---|---|---|---|
| (13) | $Ni^{2+}$, | 1-$SO_2C_2H_5$, | 1, | 1-$CH_3$, | $-N(C_2H_5)(C_2H_4OCH_3)$, | $(CF_3COO^-)_2$ |
| (14) | $Ni^{2+}$, | 2-$CH_3$, | 1, | 1-Cl, | $-N(C_2H_5)_2$, | $(C_6H_{13}COO^-)_2$ |
| (15) | $Cu^{2+}$, | 1-$OC_4H_9$(n), | 1, | 1-$CF_3$, | $-N(C_2H_5)_2$, | $SO_4^-$ |
| (16) | $Ni^{2+}$, | 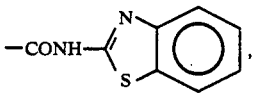 | 1, | 1-$CH_3$, | $-N(C_2H_5)_2$, | $[(C_6H_5)_4B^-]_2$ |
| (17) | $Ni^{2+}$, | $-NHCOCF_3$, | 1, | 1-$CH_3$, | $-OH$, | $[(C_6H_5)_4B^-]_2$ |
| (18) | $Cu^{2+}$, | 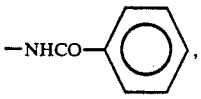 | 1, | 1-$CH_3$, | $-OC_2H_5$, | $[(C_6H_5)_4B^-]_2$ |

The compound (19) included in the formula [I] is represented by the following structural formula:

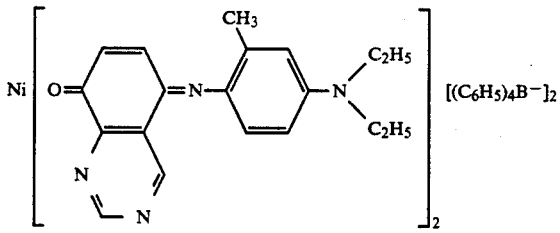

The compound (20) included in the formula [I] is represented by the following structural formula:

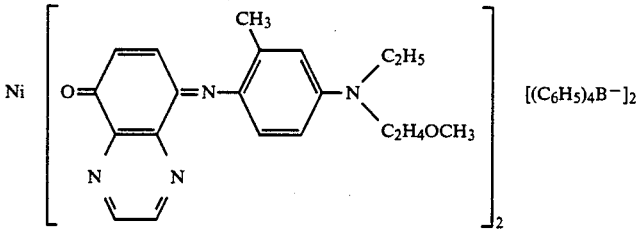

The compound represented by the formula [I] can be synthesized according to the synthetic method disclosed in Japanese Unexamined Patent Publication No. 227,569/1988.

As the colorant contained in the colorant layer of the heat-sensitive transfer recording material of the present invention, it may be chosen depending on the system of the heat-sensitive transfer recording material of the present invention, namely whether it is the heat melting transfer system or the sublimation transfer system, but the heat-sensitive transfer recording material of the present invention may be preferably the sublimitation transfer system, and therefore as the colorant, thermally diffusible dyes (sublimable dyes) are preferred. For example, as cyan dyes, there may included naphthoquinone dyes, anthraquinone dyes, azomethine dyes, etc. disclosed in Japanese Unexamined Patent Publications Nos. 78896/1984, 227948/1984, 24996/1985, 53563/1985, 130735/1985, 131292/1985, 239289/1985, 19396/1986, 22993/1986, 31292/1986, 31467/1986, 35994/1986, 49893/1986, 148269/1986, 191191/1987, 91288/1988, 91287/1988, 290793/1988. etc.

As magenta dyes, there may be included anthraquinone dyes, azo dyes, azomethine dyes, etc disclosed in Japanese Unexamined Patent Publications Nos. 78896/1984, 30392/1985, 30394/1985, 253595/1985, 262190/1986, 5992/1988, 205288/1988, 159/1989, 63194/1989, etc.

As yellow dyes, there may be included methine dyes, azo dyes, quinophthalone dyes, anthraisothiazole dyes, etc. disclosed in Japanese Unexamined Patent Publications Nos. 78896/1984, 27594/1985, 31560/1985, 53565/1985, 12394/1986, 122594/1988, etc.

Particularly preferable dyes are azomethine dyes obtained by the coupling reaction between the compound having active methylene group of the open-chain type or closed-chain type and the oxidized product of a p-phenylene-diamine derivative or the oxidized product of a p-aminophenol derivative, and indoaniline dyes obtained by the coupling reaction between a phenol or naphthol derivative and the oxidized product of a p-phenylenediamine derivative or the oxidized product of a p-aminophenol derivative. In the case of these dyes, particularly higher sensitization and good color reproducibility can be accomplished in the constitution of the present invention.

Also, the chelatable dyes represented by the formula [II] or [III] shown below can be preferably used.

Formula [II]

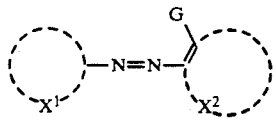

[wherein $X^1$ represents a mass of atoms necessary for completion of an aromatic carbon ring or heterocyclic ring of which at least one ring is constituted of 5 to 7 atoms, and also at least one atom adjacent to the carbon bonded to the azo bond is (a) nitrogen atom or (b) carbon atom substituted with nitrogen atom, oxygen atom or sulfur atom, $X^2$ represents a mass of atoms necessary for completion of an aromatic carbon ring or heterocyclic ring of which at least one ring is constituted of 5 to 7 carbon atoms, and G represents a chelation group].

Formula [III]

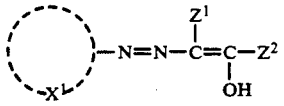

[wherein $X^1$ has the same meaning as that defined in the formula [II], $Z^1$ represents an electron attracting group, and $Z^2$ represents an alkyl group or aryl group].

In the heat-sensitive transfer recording material by use of a chelatable dye represented by the above formula [II] or [III], the above dye reacts with the metal ions added in the image-receiving layer of the image-receiving material to form a chelate dye, whereby an image excellent in fixability and weathering resistance can be obtained.

Examples of the binder which is one component for forming the colorant layer in the present invention can include water-soluble polymers such as the cellulose type, the polyacrylic acid type, the polyvinyl alcohol type, the polyvinyl pyrrolidone type, etc., polymers soluble in organic solvents such as acrylic resin, methacrylic resin, polystyrene, polycarbonate, polysulfone, polyether sulfone, polyvinyl butyral, polyvinyl acetal, nitro cellulose, ethyl cellulose, etc.

As the layer adjacent to the colorant layer in the present invention, a layer provided between the colorant layer and the support (subbing layer) or the layer provided as the upper layer on the colorant layer (protective layer) may be included.

As the subbing layer, an adhesive layer provided for the purpose of enhancing adhesiveness between the colorant layer and the support or a diffusion preventive layer provided for the purpose of preventing diffusion of the colorant toward the support side may be included.

These layers are constituted of the polymer forming the above-mentioned binder as the main component, and various additives (e.g. mold release agents, adhesives, thermally fusible substances, etc.) can be added, if necessary.

In the case of the diffusion preventive layer, in addition to the binders as mentioned above, gelatin may be also preferably employed.

In the present invention, the compound represented by the above formula [I] in the present invention is contained in the above-mentioned colorant layer and/or a layer adjacent to the colorant layer.

The amount of the compound employed, irrespectively of whether it may be contained in either layer, may be generally 0.01 to 10 g per 1 $m^2$ of the support, more preferably 0.05 to 5.0 g. The amount of the above-mentioned dye may be generally 0.05 to 5 g per 1 $m^2$ of the support, more preferably 0.1 to 2.0 g.

The amount of the binder used in the colorant layer and the layer adjacent to the colorant layer may be generally 0.1 g to 50 g per 1 $m^2$ of the support, preferably 0.2 to 5 g.

The thickness of the colorant layer may be 0.1 μm to 5 μm as dry film thickness, preferably 0.5 to 3 μm.

The heat-sensitive transfer recording material has the above-mentioned colorant formed on a support.

As the above-mentioned support, any material which has good dimensional stability and can stand the heat during recording at the head may be employed, and tissue paper such as condenser paper, glassine paper, heat-resistant plastic film such as polyethylene terephthalate, polyamide, polycarbonate can be employed.

The thickness of the support may be preferably 2 to 30 μm, and the support may also have a subbing layer for the purpose of improving adhesiveness with the binder or preventing transfer, dyeing of the dye onto the support side.

Further, the support may also have a slipping layer on the back (opposite side to the ink layer) for the purpose of sticking of the head to the support.

The above-mentioned colorant layer can be obtained by preparing a coating material for formation of the colorant layer by dissolving or dispersing into fine particles one or two or more kinds of the above-mentioned dyes together with a binder into a solvent, and coating and drying the coating material for formation of the colorant layer onto the support.

When a polymer soluble in an organic solvent is used as the binder, it can be used not only as a solution dissolved in an organic solvent, but also in the form of a latex dispersion.

As the solvent for preparing a coating material for formation of the colorant layer, there may be included water, alcohols (e.g. ethanol, propanol), cellosolves (e.g. methylcellosolve), esters (e.g. ethyl acetate), aromatics (e.g. toluene, xylene, chlorobenzene), ketones (e.g. acetone, methyl ethyl ketone), ethers (e.g. tetrahydrofuran, dioxane), chlorine type solvents (e.g. chloroform, trichloroethylene), etc.

The dye thus obtained is coated on the support by use of bar coater, roll coater, reverse roll coater, knife coater, rod coater, air doctor coater, screen printing, gravure printing, etc.

The heat-sensitive transfer recording material of the present invention has basically a structure having a colorant layer comprising a compound represented by the above formula [I] in the present invention, a dye and a binder provided on a support, a structure having a colorant layer comprising a dye and a binder provided on a support and further having a layer containing a compound represented by the above formula [I] in the present invention laminated on the colorant layer, or a structure having a colorant layer containing a colorant and a binder and a layer adjacent to the colorant layer formed and containing a compound represented by the above formula [I] in the both layers. However, it may also have a thermally fusible layer containing a thermally fusible compound as disclosed in Japanese Unexamined Patent Publication No. 106,997/1984 on the above-mentioned colorant layer.

As the thermally fusible compound, a colorless or white compound having a melting point of 65° to 130° C. may be preferably used, including waxes such as carnauba wax, beeswax, canderilla wax or the like, higher fatty acids such as stearic acid, behenic acid or the like, alcohols such as xylytol or the like, amides such as acetamide, benzoamide or the like, ureas such as phenylurea, diethylurea or the like.

In the thermally fusible layer, for enhancing retentivity of the dye, for example, a polymer such as polyvinyl pyrrolidone, polyvinyl butyral, saturated polyester, etc. may be also contained.

The heat-sensitive transfer recording material of the present invention can form a monocolor image by containing a kind of dye in the above-mentioned colorant layer, but when recording a full-color image, it is preferable that the total three layers of the cyan colorant layer containing a cyan dye, the magenta colorant layer containing a magenta dye and the yellow colorant layer containing a yellow dye should be coated successively repeatedly on the same surface of the support. Even in such case, the above-mentioned three layers contain the compound represented by the above formula [I].

If necessary, the total four layers including the colorant layer containing a black image forming substance in addition to the yellow colorant layer, magenta color layer and cyan colorant layer may be also coated successively repeatedly on the same surface of the support.

By use of the heat-sensitive transfer recording material of the present invention, an image can be formed in the following manner.

That is, as shown in FIG. 1, when the heat-sensitive transfer recording material 6 comprises the support 4 and the colorant layer 5 by use of the image-receiving material 3 having the image-receiving substrate 1 and the image-receiving layer 2, and, for example, a light such as laser beam corresponding to an image information is irradiated from the support 4 side, the compound represented by the above formula [I] in the colorant layer 5 converts the photoenergy of the laser beam to heat energy to generate heat, whereby the dye in the colorant 5 is diffusion migrated to the image-receiving material 3 by this heat generation to form an image with the above dye compound in its image-receiving layer 2.

The above-mentioned image-receiving substrate can be formed generally of paper, plastic film or paper-plastic film composite. The image-receiving layer can be formed of a polymer layer comprising one or two or more kinds of polyester resin, polyvinyl chloride resin, copolymer resin of vinyl chloride with other monomers (e.g. vinyl acetate, etc.), polyvinyl butyral, polyvinyl pyrrolidone, polycarbonate, etc.

In the image-receiving layer, a basic compound and/or a mordant should be preferably contained.

The above-mentioned basic compound is not particularly limited, but inorganic or organic basic compounds may be employed, such as calcium carbonate, sodium carbonate, sodium acetate, alkylamine, etc.

As the above-mentioned mordant, compounds having tertiary amino group, compounds having nitrogen containing heterocyclic group and compounds having quaternary cationic groups of these may be included.

Further, in the above-mentioned image-receiving layer, mold release agents such as silicone oil, etc., antioxidants, image stabilizers such as UV-absorbers, etc. may be also contained.

When the sublimable dye represented by the above formula [II] or the sublimable dye represented by the above formula is contained in the colorant layer as mentioned above, it is desirable to permit metal ions to exist in the image-receiving material or the thermally fusible layer.

As the above-mentioned metal ions, divalent and polyvalent metals belonging to the group I to the group VIII of the periodic table may be included, and among them Al, Co, Cr, Cu, Fe, Mg, Mn, Mo, Ni, Sn, Ti and Zn are preferred, particularly Ni, Cu, Cr, Co and Zn.

As the compounds for supplying these metal ions (hereinafter sometimes called metal sources), inorganic or organic salts of said metals and complexes of said metals may be included, particularly preferably salts and complexes of organic acids.

To mention specific examples, there are salts of $Ni^{2+}$, $Cu^{2+}$, $Cr^{2+}$, $Co^{2+}$ and $Zn^{2+}$ with lower fatty acids such as acetic acid, etc., salts with higher fatty acids such as stearic acid, etc. or salts with aromatic carboxylic acids such as benzoic acid, salicylic acid, etc.

Also, the complexes represented by the formula shown below can be also preferably used.

$$[M'(Q_1)(Q_2)_m(Q_3)_n]^{p+}(W^-)_p$$

In the above formula, M' represents a metal ion, preferably $Ni^{2+}$, $Cu^{2+}$, $Cr^{2+}$, $Co^{2+}$, $Zn^{2+}$.

$Q_1$, $Q_2$ and $Q_3$ each represent a coordinated compound capable of coordination bonding with the metal ion represented by M', which may be either the same or different from each other.

These coordinated compounds can be chosen from, for example, the coordinated compounds described in Chelate Chemistry (5) (Nankodo).

W represents an organic anion, including specifically tetraphenylboron anion, alkylbenzensulfonic acid anion, etc.

l represents an integer of 1, 2 or 3, m represents 1, 2 or 0, and n represents 1 or 0, and these may be determined depending on whether the complex represented by the above formula is tetradentate coordination or hexadentate coordination, or the number of the ligands of $Q_1$, $Q_2$, $Q_3$.

p represents 1 or 2, preferably 2.

When p is 2, the ligand of the coordinated compound represented by $Q_1$, $Q_2$, $Q_3$ will not be anionized.

In addition to those mentioned above, the complex compounds described in Japanese Patent Publication No. 11535/1961, Japanese Unexamined Patent Publications Nos. 48210/1980 and 129346/1980 can be also used as the metal source.

The amount of the metal source added may be generally preferred to be 0.5 to 20 g/m$^2$, more preferably 1 to 20 g/m$^2$, based on the image-receiving material or the thermally fusible layer.

Figure 2:
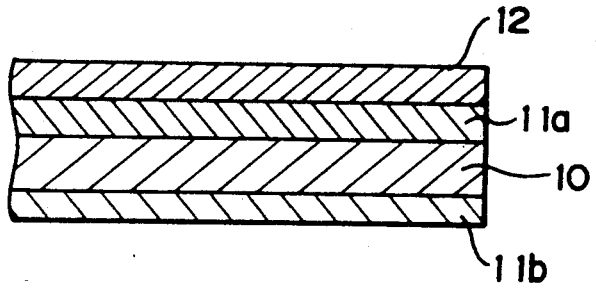
FIG. 2 is an illustration showing an example of the image-receiving material.

Next, an example of preferable image-receiving material is shown in FIG. 2. As shown in FIG. 2, the image-receiving material has a constitution comprising polyethylene layers 11*a*, 11*b* laminated on the both surfaces of the paper 10, and further the polyvinyl chloride layer 12 which is the image-receiving layer laminated on the polyethylene layer 11*a* on one side thereof.

On the other hand, as another preferable embodiment of the present invention, when the heat-sensitive transfer recording medium comprises a colorant layer comprising a colorant and a binder provided on a support, and further a layer containing a compound represented by the above formula [I] provided adjacent to the colorant layer, if, for example, a laser beam corresponding to the image information is irradiated from the support side, the compound represented by the above formula [I] contained in the colorant layer generates heat by converting the photoenergy of the laser beam to heat energy, by which heat generation the dye in the colorant layer is diffusion migrated to the image-receiving material to form an image with the above dye compound in the image-receiving layer.

Figure 3:
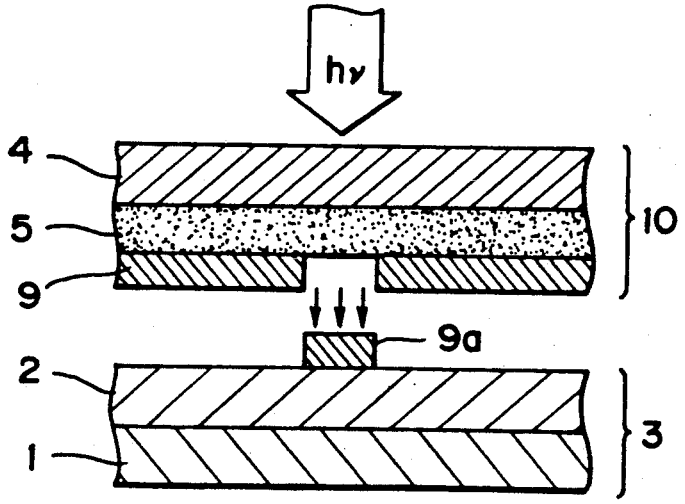
FIG. 3 is an illustration showing the image forming principle in an embodiment of the heat-sensitive transfer recording material of the present invention.

As still another embodiment of the heat-sensitive transfer recording material, as shown in FIG. 3, when the heat-sensitive transfer recording material 10 has thermally fusible layer 9 provided on the surface of the colorant layer 5 provided on the surface of the support 4 and the compound represented by the above formula [I] is contained in the above-mentioned colorant layer, if, for example, the laser beam corresponding to an image information is irradiated from the support side, the compound represented by the above formula [I] generates heat by converting the photoenergy of the laser beam to heat energy, by which heat generation the above-mentioned dye in the colorant layer 5 is diffusion migrated to the thermally fusible layer 9, and then the thermally fusible substance 9*a* containing the dye is migrated to the image-receiving material 3 by agglomeration destruction or interface peel-off.

When the heat-sensitive transfer recording material shown in FIG. 3 is used, the image-receiving material is not particularly limited, provided that it is a material which can retain the thermally fusible layer peeled off. It may be also the image-receiving material to be used for the heat-sensitive transfer recording material (an example is shown in FIG. 1) having a colorant layer on the support, or alternatively it may be also constituted only of the image-receiving substrate.

As described in detail above, in the present invention, the compound represented by the formula [I] converts the photoenergy corresponding to an image information to heat energy, forms an image on the image-receiving material surface by diffusion migration of the dye with the heat energy converted, or melts the layer in which the dye exists with the heat energy converted, thereby transferring the layer containing the dye and melted to the image-receiving layer through agglomeration destruction or interface destruction, to form an image.

EXAMPLE 1

Preparation of heat-sensitive transfer recording material

On a 100 μm polyethylene terephthalate base applied with subbing coating of gelatin, a coating solution having the following composition was coated to an amount of the dye attached of 1.0 g/m$^2$ to prepare a heat-sensitive transfer recording material −1.

| | |
|---|---|
| Cyan dye (note 1) | 5 g |
| Compound of the Invention (1) (note 2) | 3 g |
| Nitrocellulose resin | 10 g |
| Methyl ethyl ketone | 200 ml |

Note 1: Structure of cyan dye

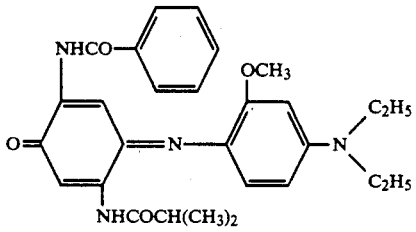

Note 2: Compound (1) of the Invention

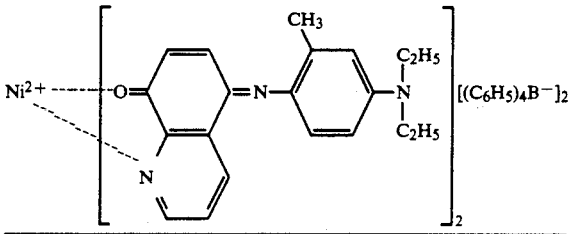

Preparation image-receiving material

On a paper support laminated with a polyethylene (containing a white pigment (titanium dioxide) and a blue agent on the side coated) with polyvinyl chloride was coated a polyvinyl chloride (attachment amount: 10 g/m$^2$) to prepare an image-receiving material.

In the image-receiving layer was incorporated 0.15 g/m$^2$ of silicone oil.

An image-receiving material was wound on the drum, and further the heat-sensitive transfer recording material-1 was wound with the colorant layer surface of the heat-sensitive transfer recording material-1 superposed on the image-receiving layer surface of the image-receiving material. On this material was irradiated a laser beam of 830 nm with a spot diameter of 40 μm, and an exposure time of 5 millisecond while rotating the drum at 160 rpm to have the cyan dye transferred onto the image-receiving material.

The irradiation energy was about 45 microwatt/μm$^2$.

On the image-receiving material, a cyan image with a density of 1.64 was obtained.

COMPARATIVE EXAMPLES 1-3

A comparative heat-sensitive transfer recording material-A (Comparative example 1) was prepared in the same manner as the heat-sensitive transfer recording material-1 except for excluding the compound (1) of the present invention from the above-mentioned heat-transfer recording material-1, a comparative heat-sensitive transfer recording material-B (Comparative example 2) in the same manner as the heat-sensitive transfer recording material-1 except for adding carbon in place of the compound (1) of the present invention, and a comparative heat-sensitive transfer recording material-C (Comparative example 3) in the same manner as the heat-sensitive transfer recording material-1 except for adding the IR-ray absorbing dye in place of the compound (1) of the present invention (the amount added of the IR-ray absorbing dye is the same as the compound (1)).

For these comparative heat-sensitive transfer recording materials, cyan images were formed according to the same method as in the case of the heat-sensitive transfer recording material-1, but substantially no transferred image could be obtained in Comparative heat-sensitive material-A, while only a transferred image with irregularity and a density of 1.24 could be obtained in Comparative heat-sensitive transfer recording material-B. In Comparative heat-sensitive transfer recording material-C, an image with substantially the same density as the heat-sensitive transfer recording material-1 (1.59) was obtained.

IR-dye

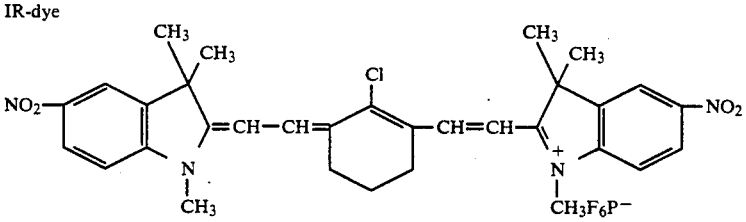

On the other hand, the heat-sensitive transfer recording material-1 and Comparative heat-sensitive transfer recording material-C were left to stand under the conditions of 77° C. and a relative humidity of 50% for 3 days, and the storage evaluation of the material was conducted.

For the heat-sensitive transfer recording material-1 and the Comparative heat-sensitive transfer recording material-C after storage, image recording was carried out under the same conditions as described above. As the result, a cyan image with a density of 1.62 was obtained in the heat-sensitive transfer recording material-1, but the density was lowered to 0.92 in the Comparative heat-sensitive transfer recording material-C.

This may be estimated to be due to the fact that IR-ray absorbing dye was decomposed in the Comparative heat-sensitive transfer recording material-C to lower the IR-ray absorbing dye, whereby the heat energy conversion efficiency to laser beam was lowered. On the other hand, in the heat-sensitive transfer recording material of the present invention, good image can be obtained by laser recording and also storability is good.

EXAMPLE 2

The heat-sensitive transfer recording materials 2–10 were prepared in the same manner as the heat-sensitive transfer recording material 1 except for using the compound (2), (3), (4), (6), (9), (10), (12), (19), (20) [the numbers are the same as the compound numbers in Table 1] (the amount added is equimolar to the compound (1)). When image recording was practiced for these heat-sensitive transfer recording materials according to the method as described in Example 1, substantially the same cyan image as in the case of the heat-sensitive transfer recording material-1 could be obtained.

EXAMPLE 3

Except for using the dyes (a), (b), (c), (d) shown below in place of the cyan dye in the heat-sensitive transfer recording material-1, heat-sensitive transfer recording materials 21–24 were prepared in the same manner as the heat-sensitive transfer recording material -1. For the heat-sensitive transfer recording materials 21–24, image formation was effected according to the same method as in Example 1.

In the image-receiving material for the heat-sensitive transfer recording material-23 and 24, the following compound (metal source, attached amount 5 g/m$^2$) is contained.

Metal source:

$[Ni(C_2H_5NHCH_2CH_2NH_2)]^{2+}[(C_6H_5)_4B]_2^-$

Dye (a)

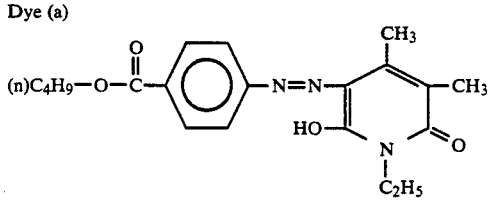

Dye (b)

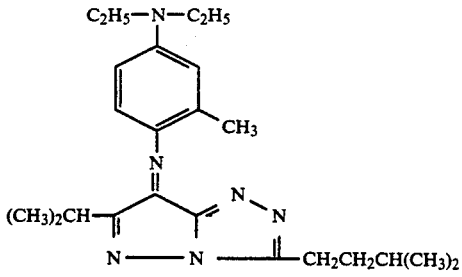

Dye (c)

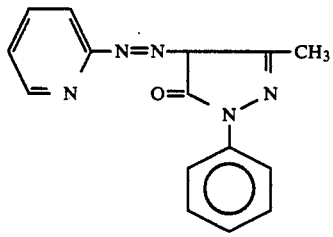

Dye (d)

-continued

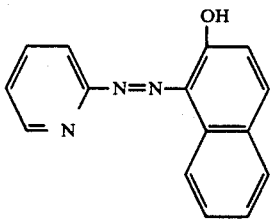

For the heat-sensitive transfer recording materials-21–24, the images of yellow or magenta with the densities shown below were obtained, respectively.

| Heat-sensitive transfer recording material | Hue | |
|---|---|---|
| −21 | Yellow | 1.62 |
| −22 | Magenta | 1.71 |
| −23 | Yellow | 1.59 |
| −24 | Magenta | 1.79. |

Thus, by use of the material of the present invention, an image of yellow, magenta and cyan can be obtained, and therefore a full color image can be obtained.

The images obtained in the heat-sensitive transfer recording materials-23 and 24 were found to have good fixability of the image as compared with other images.

According to the present invention, by irradiation of a light corresponding to an image formation, a heat-sensitive transfer recording material capable of forming a sharp image with good fixability and storability on an image-forming material can be provided.

We claim:

1. A heat-sensitive transfer recording material comprising a colorant layer containing a colorant transferable by heat; a support, and a compound represented by the formula (I) shown below, contained in said colorant layer or a layer adjacent to said colorant layer:

Formula (I)

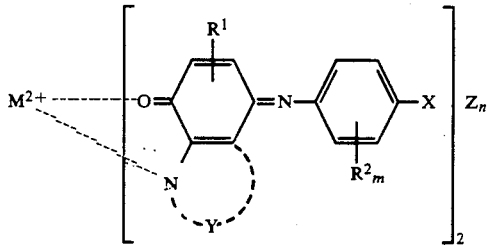

wherein $M^{2+}$ represents a chelatable metal ion, $R^1$ and $R^2$ each independently represent hydrogen atom, a halogen R atom, a monovalent organic group, X represents $—N(R_3)(R_4)$, $—OR^6$ and hydroxyl group, where $R^3$, $R^4$, $R^5$ each independently represent an alkyl group which may also have a substituent, Y represents a 6-membered nitrogen containing aromatic heterocyclic ring together with

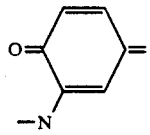

Z represents an anion, m represents 1 or 2 and n represents 1 or 2.

2. The recording material of claim 1 wherein said metal ion is a divalent transition metal ion.

3. The recording material of claim 2 wherein said metal ion is at least one selected from the group consisting of $Ni^{2+}$, $Cu^{2+}$, $Fe^{2+}$, $Co^{2+}$ and $Zn^{2+}$.

4. The recording material of claim 1 wherein said monovalent organic group is at least one selected from the group consisting of alkyl groups, cycloalkyl groups, aryl groups, alkenyl groups, aralkyl groups, alkoxy groups, aryloxy groups, cyano group, acylamino groups, alkylthio groups, arylthio groups, sulfonylamino groups, ureido groups, carbamoyl groups, sulfamoyl groups, alkoxycarbonyl groups, sulfonyl groups, acyl groups and amino groups.

5. The recording material of claim 1 wherein said 6-membered nitrogen containing aromatic heterocyclic ring is at least one selected from the group consisting of

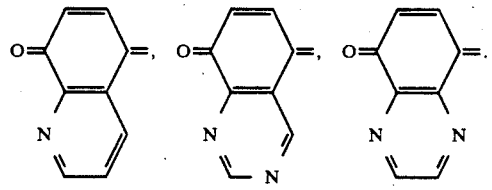

6. The recording material of claim 1 wherein said anion is at least one selected from the group consisting of $Cl^-$, $Br^-$, $ClO_4^-$, $R^6COO^-$, $R^6SO_3^-$, $R^6{}_4B^-$ and $SO_4^{2-}$ (wherein $R^6$ represents alkyl groups, cycloalkyl groups and aryl groups).

7. The recording material of claim 1 wherein said compound represented by formula (I) is at least one selected from the group consisting of

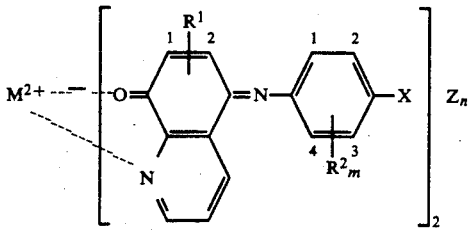

| | $M^{2+}$ | $R^1$ | m | $R^2$ | X | Z |
|---|---|---|---|---|---|---|
| (7) | $Cu^{2+}$ | 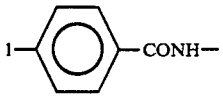 | 1 | 1-$CH_3$ | $-N(C_3H_7(n))_2$ | $[(C_6H_5)_4B^-]_2$ |
| (8) | $Co^{2+}$ | 1-$C_2H_5SO_2NH$ | 1 | 1-$CH_3$ | $-N(C_2H_5)(C_2H_4Cl)$ | $[(C_6H_5)_4B^-]_2$ |
| (9) | $Ni^{2+}$ | 1-$NHCOC_{14}H_{29}$ | 1 | 1-$CH_3$ | $-N(C_2H_5)_2$ | $[(C_6H_5)_4B^-]_2$ |
| (10) | $Ni^{2+}$ | 1-$NHCOCH(C_2H_5)O-C_5H_{11}(t)$ | 1 | 1-$CH_3$ | $-N(C_2H_5)_2$ | $(ClO_4^-)_2$ |
| (11) | $Fe^{2+}$ | 1-$CONHC_6H_{13}$ | 1 | 1-$CH_2NHSO_2CH_3$ | $-N(C_2H_5)_2$ | $[(C_{12}H_{25}-SO_3^-]_2$ |
| (12) | $Ni^{2+}$ | 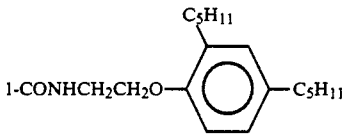 | 1 | 1-$CH_3$ | $-N(C_2H_5)_2$ | $(Cl^-)_2$ |
| (13) | $Ni^{2+}$ | 1-$SO_2C_2H_5$ | 1 | 1-$CH_3$ | $-N(C_2H_5)(C_2H_4OCH_3)$ | $(CF_3COO^-)_2$ |
| (14) | $Ni^{2+}$ | 2-$CH_3$ | 1 | 1-Cl | $-N(C_2H_5)_2$ | $(C_6H_{13}COO^-)_2$ |
| (15) | $Cu^{2+}$ | 1-$OC_4H_9(n)$ | 1 | 1-$CF_3$ | $-N(C_2H_5)_2$ | $SO_4^-$ |
| (16) | $Ni^{2+}$ | 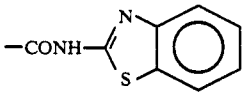 | 1 | 1-$CH_3$ | $-N(C_2H_5)_2$ | $[(C_6H_5)_4B^-]_2$ |
| (17) | $Ni^{2+}$ | $-NHCOCF_3$ | 1 | 1-$CH_3$ | $-OH$ | $[(C_6H_5)_4B^-]_2$ |
| (18) | $Cu^{2+}$ | 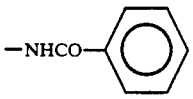 | 1 | 1-$CH_3$ | $-OC_2H_5$ | $[C_6H_5)_4B^-]_2$ |

8. The recording material of claim 1 wherein said compound represented by formula (I) is at least one selected from the group consisting of -continued

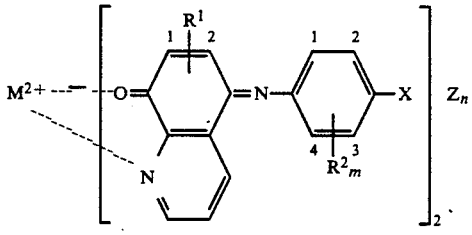

| | $M^{2+}$ | $R^1$ | m | $R^2$ | X | Z |
|---|---|---|---|---|---|---|
| (1) | $Ni^{2+}$ | H | 1 | 1-$CH_3$ | $-N(C_2H_5)_2$ | $[(C_6H_5)_4B^-]_2$ |
| (2) | $Cu^{2+}$ | H | 1 | 1-$CH_3$ | $-N(C_2H_5)_2$ | $[(C_6H_5)_4B^-]_2$ |

-continued

| | $M^{2+}$ | $R^1$ | m | $R^2$ | X | Z |
|---|---|---|---|---|---|---|
| (3) | $Ni^{2+}$ | 1-$CH_3$ | 1 | 1-$OCH_3$ | $-N(C_2H_5)(C_2H_4OH)$ | $[(C_6H_5)_4B^-]_2$ |
| (4) | $Cu^{2+}$ | 1-Cl | 2 | 1-$CH_3$, 3-$CH_3$ | $-N(C_2H_5)(C_2H_4OCH_3)$ | $[(C_6H_5)_4B^-]_2$ |
| (5) | $Zn^{2+}$ | 1-Cl | 1 | 1-$CH_3$ | $-N(C_2H_5)(C_2H_4NHSO_4CH_3)$ | $[(C_6H_5)_4B^-]_2$ |
| (6) | $Ni^{2+}$ | 1-$C_2H_5CONH$— | 1 | H | $-N(C_2H_5)(C_2H_5)$ | $[(C_6H_5)_4B^-]_2$ |

9. The recording material of claim 1 wherein said compound represented by formula (I) is at least one selected from the group consisting of

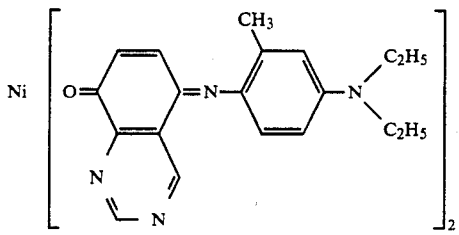

$[(C_6H_5)_4B^-]_2$ and

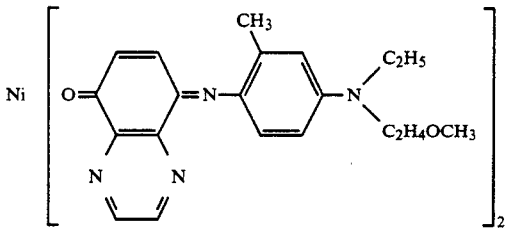

$[(C_6H_5)_4B^-]_2$. (20)

10. The recording material of claim 1 wherein said recording material is a sublimation transfer system.

11. The recording material of claim 1 wherein said colorant is a thermally diffusible or sublimable dye.

12. The recording material of claim 11 wherein said dye is an azomethine dye obtained by the coupling reaction between a compound having an open chain active methylene group or a closed-chain active methylene group and the oxidized product of a p-phenylenediamine compound or the oxidized product of a p-aminophenol compound.

13. The recording material of claim 11 wherein said dye is an indoaniline dye obtained by the coupling reaction between a phenol or naphthol compound and the oxidized product of a p-phenylenediamine compound or the oxidized product of a p-aminophenol compound.

14. The recording material of claim 1 wherein said colorant is represented by formula (II)

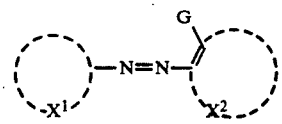

wherein $X^1$ represents a mass of atoms necessary for completion of an aromatic carbon ring or heterocyclic ring of which at least one ring is constituted of 5 to 7 atoms, and also at least one atom adjacent to the carbon bonded to the azo bond is (a) nitrogen atom or (b) carbon atom substituted with nitrogen atom, oxygen atom or sulfur atom, X2 represents a mass of atoms necessary for completion of an aromatic carbon ring or heterocyclic ring of which at least one ring is constituted of 5 to 7 carbon atoms, and G represents a chelation group.

15. The recording material of claim 1 wherein said colorant is represented by formula (III)

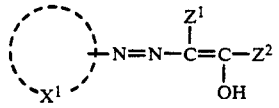

wherein $X^1$ has the same meaning as that defined in the formula (II), $Z^1$ represents an electron attracting group, and $Z^2$ represents an alkyl group or aryl group.

16. The recording material of claim 1 wherein a binder which is one component for forming said colorant layer is a water-soluble polymer selected from the group consisting of cellulose, polyacrylic acid, polyvinyl alcohol and polyvinyl pyrrolidone, and polymers soluble in organic solvents selected from the group consisting of acrylic resin, methacrylic resin, polystyrene, polycarbonate, polysulfone, polyether sulfone, polyvinyl butyral, polyvinyl acetal, nitro cellulose and ethyl cellulose.

17. The recording material of claim 1 wherein the layer adjacent to the colorant layer is a subbing layer.

18. The recording material of claim 1 wherein said layer adjacent to the colorant layer is a protective layer.

19. The recording material of claim 1 wherein the compound represented by formula (I) is present in an amount of 0.01 to 10 g per 1 $m^2$ of the support.

20. The recording material of claim 19 wherein said colorant is a dye which is present in an amount of 0.05 to 5 g per 1 $m^2$ of the support.

21. The recording material of claim 1 wherein the thickness of said colorant layer is 0.1 to 5 $\mu$m as dry film thickness.

22. The recording material of claim 21 wherein the thickness of said colorant layer is 0.5 to 3 $\mu$m as dry film thickness.

23. The recording material of claim 1 wherein said colorant is a dye which is present in an amount of 0.05 to 5 g per 1 $m^2$ of the support.

* * * * *